United States Patent [19]

Raitto

[11] Patent Number: 4,667,958

[45] Date of Patent: May 26, 1987

[54] NIGHTSTICK

[76] Inventor: David A. Raitto, P.O. Box 125, Wheelwright, Mass. 01094

[21] Appl. No.: 708,700

[22] Filed: Mar. 6, 1985

Related U.S. Application Data

[63] Continuation of Ser. No. 444,480, Nov. 24, 1982.

[51] Int. Cl.[4] ..... F41B 15/02

[52] U.S. Cl. ..... 273/84 R; 273/DIG. 1; 264/259

[58] Field of Search ..... 273/84 R, DIG. 6, DIG. 1, 273/84 ES

[56] References Cited

U.S. PATENT DOCUMENTS

| | | | |
|---|---|---|---|
| De. 230,150 | 1/1974 | Anderson | 273/84 R |
| 2,486,952 | 11/1949 | Kearsley et al. | 273/DIG. 6 |
| 3,944,226 | 3/1976 | Starrett | 273/84 R |
| 3,981,504 | 9/1976 | Gugel | 273/DIG. 1 |
| 4,013,288 | 3/1977 | Goverde | 273/DIG. 6 |
| 4,203,599 | 5/1980 | Starrett | 273/84 R |

OTHER PUBLICATIONS

"Machine Design" Nov. 26, 1959, pp. 151-154.

*Primary Examiner*—George J. Marlo
*Attorney, Agent, or Firm*—Blodgett & Blodgett

[57] ABSTRACT

A nighstick comprising an elongated cylindrical main body portion and a generally cylindrical handle portion which is integral with the main body portion and extends at a right angle to the central longitudinal axis of the main body portion. The handle portion is spaced from both ends of the main body portion and is substantially closer to one of the ends. The invention includes a nightstick in which the handle and main body portions are molded as a single integral unit of thermoplastic polycarbonate material. The invention also includes a nightstick as described above which consists of a T-shaped metallic core embedded in thermoplastic material and the method of making same. Another variation of the invention includes a nightstick in which the main body portion is covered by an outer layer of elastomeric material. Still another variation of the invention includes a nightstick in which the main body portion and the handle portion each consist of a metal tube filled with elastomeric material.

1 Claim, 15 Drawing Figures

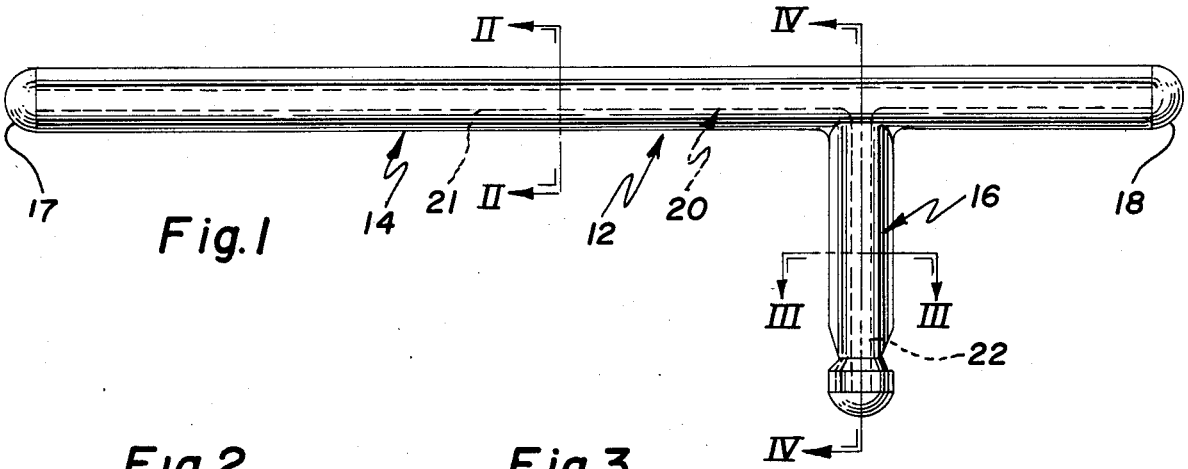
Fig. 1
Fig. 2
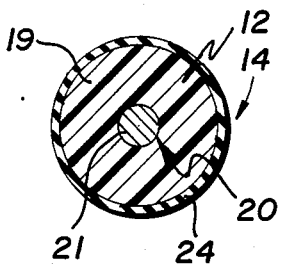
Fig. 3
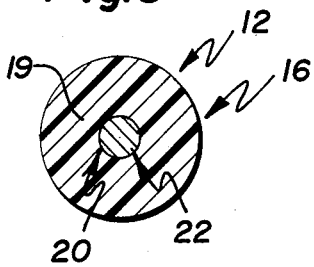
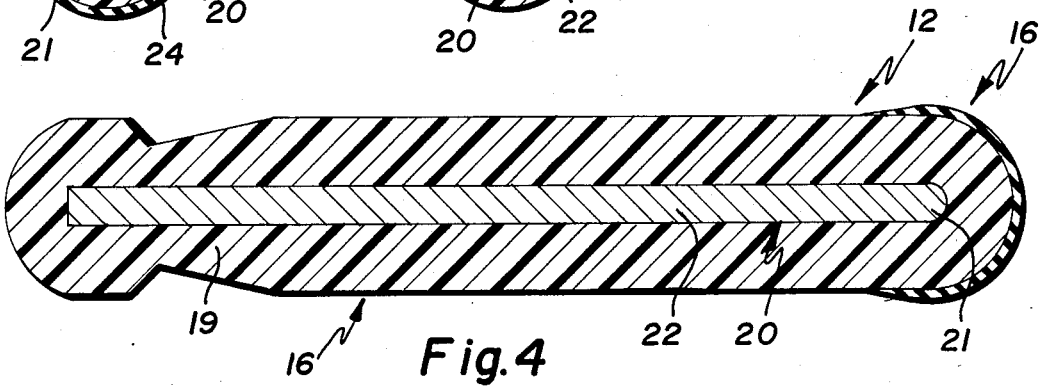
Fig. 4
Fig. 5
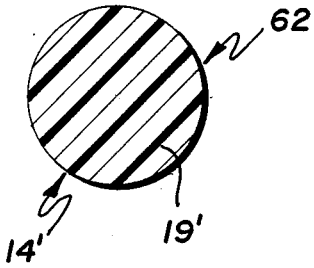
Fig. 6
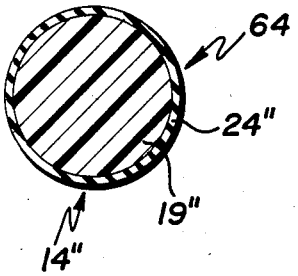
Fig. 7
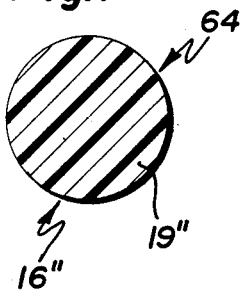
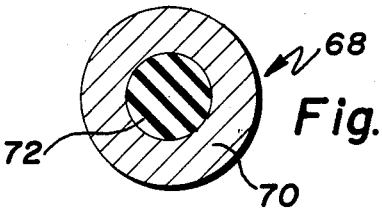
Fig. 8

NIGHTSTICK

This is a continuation of co-pending application Ser. No. 444,480, filed on Nov. 24, 1982.

BACKGROUND OF THE INVENTION

The invention relates generally to a nightstick of the type used by law enforcement personnel and a method of making the nightstick. Specifically, the invention relates to the type of nightstick which comprises an elongated cylindrical main body portion and a generally cylindrical handle portion which extends at a right angle to the main body portion. The handle is spaced from both ends of the main body portion, but is substantially closer to one of the ends.

The handle and main body portions of the prior art nightstick are separate pieces which are machined from extruded thermoplastic stock. After machining, the handle portion is bolted or screwed to the main body portion.

One of the principle disadvantages of the prior art nightstick is that after a period of use, the handle becomes loose and must be continuously tightened. Sometimes, the handle breaks away from the main body portion during use. Occasionally, the main body portion breaks as a result of a particularly forceful blow of the nightstick. When the nightstick breaks, a portion of the nightstick flies away at high velocity, thus creating a potential hazard to the user or to an innocent bystander. Breakage usually occurs at the most critical moment of use, rendering the nightstick ineffective for further use. This represents the loss of a controlled subduing force and creates a hazardous situation for the user. These and other difficulties experienced with the prior art devices have been obviated in a novel manner by the present invention.

It is, therefore, an outstanding object of the invention to provide a nightstick of the general type described above in which the handle never becomes loose with respect to the main body portion.

Another object of the invention is the provision of a nightstick in which breakage of the nightstick is greatly minimized.

A further object of the present invention is the provision of a nightstick which requires no machining and assembly.

It is another object of the instant invention to provide a nightstick which includes a reinforcing element that further reduces the possibility of breakage and eliminates the possibility of a broken piece from flying away, if breakage does occur.

It is a further object of the invention to provide a nightstick which is strong, rigid, and has shock absorbing qualities.

A still further object of the invention is the provision of a nightstick which is simple in construction, which is inexpensive to manufacture and which is capable of a long life of useful service.

With these and their objects in view, as will be apparent to those skilled in the art, the invention resides in the combination of parts set forth in the specification and covered by the claims appended hereto.

SUMMARY OF THE INVENTION

In general, the invention consists of a nightstick having an elongated cylindrical main body portion and a generally cylindrical handle portion which is integral with and extends at a right angle to the main body portion. The handle portion is spaced from both ends of the main body portion and is substantially closer to one of the ends. More specifically, the main body portion and the handle each comprise a metal core surrounded by thermoplastic material. The metal core of the handle being integral with the metal core of the main body portion and the plastic portion of the handle being integral with the plastic portion of the main body portion. The invention also comprises a method of injection molding a thermosplastic nightstick with a metal core.

The invention also consists of a mold for plastic injection molding apparatus for forming a plastic article having a core element embedded therein.

BRIEF DESCRIPTION OF THE DRAWINGS

The character of the invention, however, may be best understood by reference to one of its structural forms, as illustrated by the accompanying drawings, in which:

FIG. 1 is a side elevational view of a nightstick embodying the principles of the present invention, FIG. 2 is a vertical sectional view of the main body portion of the nightstick taken on the line II—II of FIG. 1, FIG. 3 is a horizontal sectional view of the handle portion of the nightstick taken on the line III—III of FIG. 1, FIG. 4 is a vertical sectional view of the nightstick taken on the line IV—IV of FIG. 1, FIG. 5 is a cross-sectional view of a first modification, FIGS. 6 and 7 are cross-sectional views of a second modification, FIG. 8 is a cross-sectional view of a third modification.

DESCRIPTION OF THE PREFERRED EMBODIMENT

Figure 9:
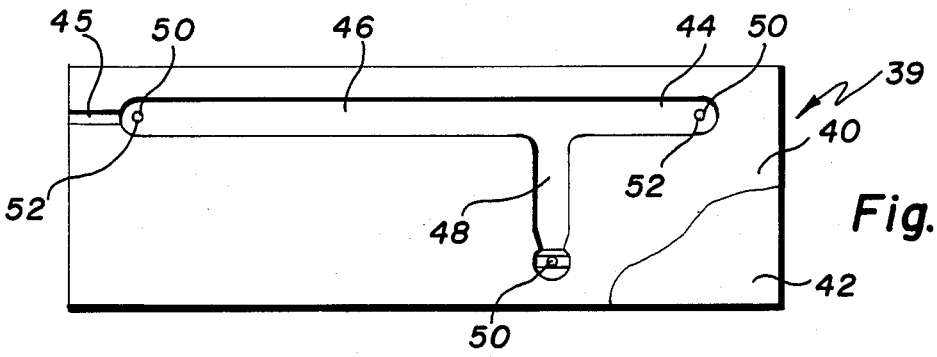
FIGS. 9–11 are diagrammatic views which illustrate a method of forming a nightstick of the preferred form of the invention which is illustrated in FIGS. 1–4.

Referring first to FIGS. 1–4, the nightstick of the preferred embodiment is generally indicated by the reference numeral 12 and consists of a main body portion generally indicated by the reference numeral 14 and a handle portion generally indicated by the reference numeral 16.

The main body portion 14 of the nightstick is elongated and cylindrical. The handle portion 16 is generally cylindrical and extends at a right angle from the main body portion 14. The handle 16 is integral with the main body portion 14 and is spaced from the opposite ends of the main body portion, indicated at 17 and 18. However, the handle 16 is substantially closer to the end 18 than the end 17. The nightstick 12 consists primarily of a relatively rigid thermoplastic material 19 which surrounds a metal core generally indicated by the reference numeral 20. The plastic material is preferably polycarbonate or nylon. The metal core 20 has a main body portion 21 which extends within the main body 14 and a handle portion 22 which extends in the handle portion 16. The main body portion 21 and the handle portion 22 of the core are integral and preferably made of steel. The thermoplastic material 19 which surrounds the portions 21 and 22 of the core is also integral. The outside of the main body portion 14 is covered with a elastomeric material 24 which may be natural rubber or synthetic rubber such as polyurethane.

Figure 12:
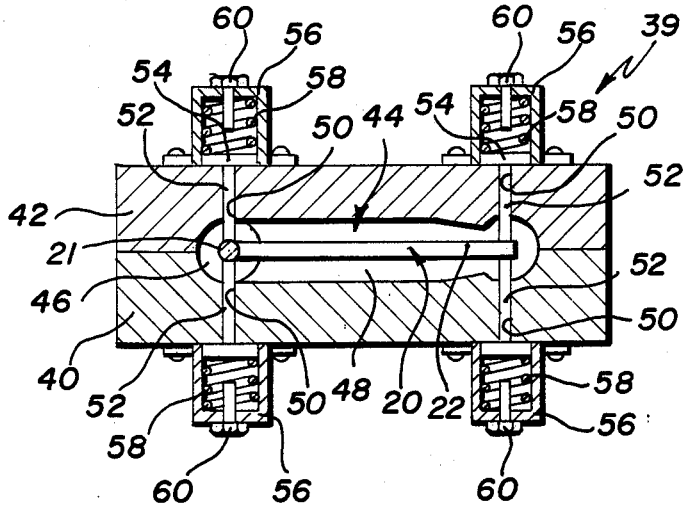
FIG. 12 is a vertical cross-sectional view taken on the line XII—XII of FIG. 10, FIGS. 13 and 14 are fragmentary cross-sectional views of a portion of FIG. 12, on an enlarged scale.

The method of making the nightstick of the preferred embodiment is illustrated in FIGS. 7–10. The nightstick 12 is made by providing a plastic injection mold generally indicated by the reference numeral 39 and consisting of two separable half portions 40 and 42. The mold 39 contains a cavity, generally indicated by the reference numeral 44, having the shape of the nightstick 12. Half of the cavity 44 is in the mold half 40 and the other half of the cavity 44 is in the mold half 42 as shown in FIG. 12. The cavity 44 consists of a main body portion 46 and a handle portion 48. An inlet port 45 extends from the main body portion 46 to conventional plastic injection apparatus, not shown.

Figure 13:
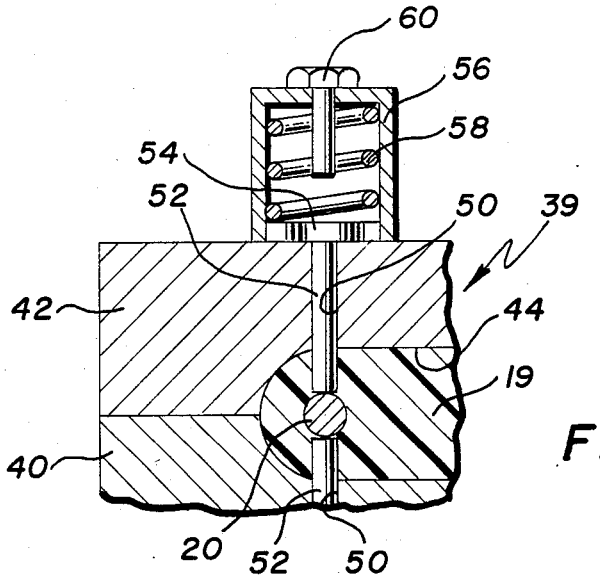

Referring particularly to FIG. 12, each mold half has a plurality of apertures 50 which extend from the cavity 44 to the outside of the mold. There is an aperture 50 at each end of the main body portion 46 and at the end of the handle portion 48 for each mold half. The apertures 50 of the mold half 40 are axially aligned with the corresponding apertures 50 of the mold half 42. Each aperture 50 contains a pin 52 which is axially slidable within the aperture. The inner free end of each pin 52 extends into the cavity 44. The outer end of each pin is attached to a flange 54 which is slidably mounted within a housing 56 which is fixed to the outside of the mold half. A spring 58 bears against the flange 54 and urges the pin 52 toward the cavity 44 so that the free ends of each opposing set of pins 52 are urged toward each other as shown in FIGS. 12 and 13. Each housing 56 is provided with an adjustable stop 60 which prevents the inner free end of the pin 52 from being pushed outwardly beyond the intersection of the aperture 50 and cavity 44.

Figure 10:
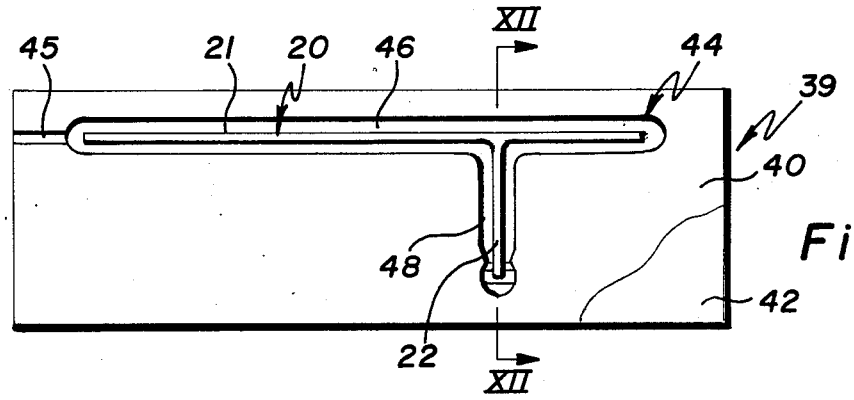
Figure 11:
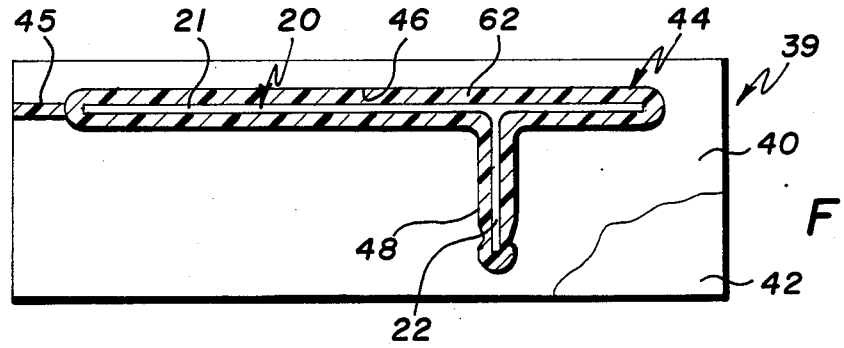
Figure 14:
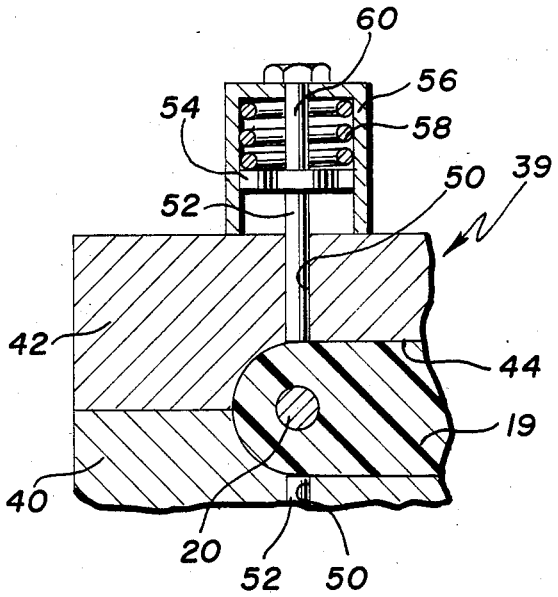

At the beginning of a molding operation, the upper mold half 42 is separated or opened from the lower mold half 40. The reinforcing core 20 is placed within the cavity 44 so that the main body portion 21 of the core lies in the main body portion of the cavity and the handle portion 22 of the core lies within the handle portion of the cavity. The core 20 is supported on the lower pins 52. The core 20 is preferably made of a ferrous material and the lower pins 52 are magnetized for holding the core 20 in position. The upper mold half 42 is joined to the lower mold half 40 so that of the lower ends of the upper pins 52 engage the core 20. The core 20 is thereby retained between the upper and lower sets of pins 52 and positioned centrally of the cavity 44, vertically as shown in FIG. 12 and horizontally as shown in FIG. 10. Once that the core 20 is properly positioned within the mold cavity, plasticised thermoplastic material 19 is injected under pressure into the cavity through the inlet port 45 until the entire cavity is filled as shown in FIGS. 11 and 13. When the pressure of the thermoplastic material 19, within the cavity 44 reaches a value which is sufficient to overcome the biasing effect of the springs 58, the pins 52 are forced outwardly away from the core 20 until the flanges 54 strike the stops 60. At this point, the inner ends of the pins are located at the intersection of the apertures 50 and the cavity 44 as shown in FIG. 14. A portion of the end surface of each pin 52 must be exposed to the plastic material for the pin to be pushed out of the mold by the pressure of the plastic material. In the preferred form of the invention, a cylindrical reinforcing core is used so that it is sufficient that the end surface of the inner free end of the pin be flat or slightly convex. However, if a rectangular core were to be used, the end surface of the pin 52 would have a different configuration, for example, convex.

It is also contemplated that the mold can be used for molding many other articles having a core element embedded in thermoplastic material. After the thermoplastic material has cooled or curred sufficiently, the mold halves 40 and 42 are opened and the nightstick, consisting of a metal core embedded in thermoplastic material, is removed from the mold. The sprue of thermoplastic material from the inlet port 45 is removed from the nightstick, resulting in a finished product. The nightstick of the preferred embodiment, illustrated in FIGS. 1–4, is produced by coating the main body portion of the nightstick after it is taken out of the plastic injection mold. The elastomeric coating may be applied by any conventional means, such as an additional molding process or mechanical application.

The nightstick 12 consists primarily of a thermoplastic material which provides the desired weight and handling characteristics for the nightstick. The thermoplastic material 19 of the handle portion 16 is integral with the thermoplastic material of the main body portion 14, so that the handle will not become loosened with respect to the main body portion and is much less likely to break from the main body portion. The metal core 20 further reduces the possibility of breakage of the handle portion 16 from the main body portion 14 as well as breakage along any part of the main body portion. In addition, if breakage does occur, it will be in the nature of a fracture of the thermoplastic material and the fractured portion will be prevented from flying away from the nightstick by the core, since it is molded to the core.

The layer of elastomeric material 24 provides protection to the user for certain maneuvers commonly performed when the nightstick is used for self-defense and for added control of the use of force when the nightstick is used for the purpose of subduing an individual. When the nightstick is used for self-defense, it may be held in front of or against the users body to absorb a blow by an attacker. The elastomeric material softens the blow at the point of impact on the stick and also provides a cushioning affect from the blow at the point where the stick is in contact with the users body. It is preferred that there be no elastomeric material on the handle portion of the nightstick since some maneuvers of the nightstick require twirling of the nightstick, wherein the handle portion 16 rotates within the users hand.

FIRST MODIFICATION

Figure 15:
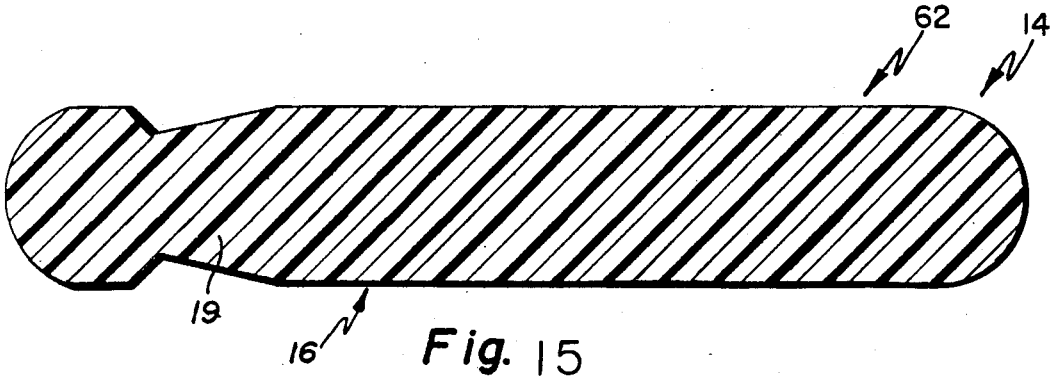
FIG. 15 is a vertical cross sectional view of the first modification through the handle and main body portions of the nightstick.

Referring to FIGS. 5 and 15 there is illustrated cross sections of a first modified nightstick, generally indicated by the reference numeral 62. The nightstick 62 has the same outer configuration as the nightstick 12, illustrated in FIG. 1, including a main body portion and a handle portion, except that the entire nightstick is made of thermoplastic material 19'. The main body portion of the nightstick 62 is shown in cross section in FIGS. 5 and 15 and is generally indicated by the reference numeral 14'. The main body portion 14' and the handle portion 16' of the nightstick 62 are integral as shown in FIG. 15 and formed by being molded as a single unit. The nightstick 62 is molded in a manner similar to that shown in FIGS. 7–10 except that no core is placed in the mold cavity prior to the introduction of thermoplastic material into the mold.

The first modified nightstick 62 retains many of the advantages of the preferred embodiment due to the integrally formed handle and main body portions. However, the nightstick 62 is simpler in construction, easier to manufacture and relatively inexpensive.

SECOND MODIFICATION

Referring to FIGS. 6 and 7, there is shown a second modified nightstick, generally indicated by the reference numeral 64. The nightstick 64 has the same general configuration as the nightstick 12 illustrated in FIG. 1, including a main body portion and a handle portion, except that the nightstick 64 is made substantially of thermoplastic material 19'' and coated with a layer of elastomeric material 24''. FIG. 6 is a cross section of the main body portion of the nightstick 64 and is indicated by the reference numeral 14''. FIG. 7 is a cross section of the handle portion which is generally indicated by the reference numeral 16''. As illustrated in FIG. 7, the handle portion 16'' is made entirely of thermoplastic material 19'' and does not have the outer layer of elastomeric material which covers the main body portion. The thermoplastic material 19'' of the handle portion 16'' is integral with the thermoplastic material 19'' of the main body portion 14''. The advantage of the nightstick 64 is that it is relatively inexpensive to manufacture and the handle portion will not become loose from or separate from the main body portion. Also, the layer of elastomeric material 24'' provides the same advantages to the user as the elastomeric material 24 of the preferred embodiment.

THIRD MODIFICATION

Referring to FIG. 8, there is shown a third modified nightstick, generally indicated by the reference numeral 68. The nightstick 68 has the same general configuration as the nightstick 12 illustrated in FIG. 1, including a main body portion and a handle portion, except that the nightstick 68 is made of the tubular metal 70 and filled with elastomeric material 72. The handle and main body portions of the nightstick 68 have the same cross section illustrated in FIG. 8. The metal of the handle portion is integral with the metal of the main body portion. The nightstick 68 is formed by molding as a single piece with the use of cores or by forming the handle and main body portions from tubular stock and welding them together. The elastomeric material 72 is either injected in a molten state into the hollow interior of the tubular metal or inserted in the solid state.

The main advantage of the nightstick 68 is that it is extremely strong. The nightstick 68 is also relatively inexpensive to manufacture and has shock absorbing qualitites due to the elastomeric material in the center.

It is obvious that minor changes may be made in the form and construction of the invention without departing from the material spirit thereof. It is not, however, desired to confine the invention to the exact form herein shown and described, but is desired to include all such as properly come within the scope claimed.

The invention having been thus described, what is claimed as new and desired to secure by Letters Patent is:

1. A nightstick consisting of (a) an elongated cylindrical main body portion having a central longitudinal axis, and (b) a generally cylindrical handle portion having a central longitudinal axis which is at a right angle to the central longitudinal axis of the main body portion, said handle portion being spaced from both ends of the main body portion and being substantially closer to one of said ends, said main body portion and said handle portion being a single molded one piece unit of polycarbonate.

* * * * *